US010150151B1

(12) United States Patent
Boyd

(10) Patent No.: US 10,150,151 B1
(45) Date of Patent: Dec. 11, 2018

(54) METAL TAB BENDING TOOL AND METHOD FOR SECURING AN UPRIGHT STUD IN PLACE AND RELATIVE TO AN ELONGATED TRACK

(71) Applicant: Michael Boyd, Danville, CA (US)

(72) Inventor: Michael Boyd, Danville, CA (US)

( * ) Notice: Subject to any disclaimer, the term of this patent is extended or adjusted under 35 U.S.C. 154(b) by 0 days.

(21) Appl. No.: 15/683,541

(22) Filed: Aug. 22, 2017

(51) Int. Cl.

| | |
|---|---|
| ***B21D 43/28*** | (2006.01) |
| ***B21D 5/02*** | (2006.01) |
| ***B21D 39/02*** | (2006.01) |
| ***H01R 43/00*** | (2006.01) |
| ***B21D 39/00*** | (2006.01) |
| ***H01J 9/28*** | (2006.01) |
| *E04B 2/72* | (2006.01) |
| *E04B 2/74* | (2006.01) |

(52) U.S. Cl.
CPC ..... *B21D 5/0209* (2013.01); *B21D 39/00* (2013.01); *B21D 39/02* (2013.01); *B21D 39/025* (2013.01); *H01J 9/28* (2013.01); *H01R 43/00* (2013.01); *E04B 2/721* (2013.01); *E04B 2002/7462* (2013.01)

(58) Field of Classification Search
CPC ..... B21D 39/02; B21D 39/00; B21D 39/025; B21D 5/0209; H01J 9/28; H01R 43/00
USPC ..... 72/411
See application file for complete search history.

(56) References Cited

U.S. PATENT DOCUMENTS 2,591,439 A 4/1952 Koch
2,800,960 A * 7/1957 Cutler ..... B21D 39/025 29/21.1
3,121,447 A * 2/1964 Zoschg ..... H01J 9/28 140/71.5
3,429,168 A 2/1969 Pearson et al.
3,722,280 A * 3/1973 Van Greuingen ..... B21D 39/00 29/521
4,041,600 A 8/1977 Ruediger
4,307,553 A 12/1981 Puckett
4,479,375 A 10/1984 Klaus et al.
(Continued)

*Primary Examiner* — David B Jones
(74) *Attorney, Agent, or Firm* — Law Office of John W, Harbst

(57) ABSTRACT

A metal tab bending tool for securing an upright stud in place and relative to an elongated track of a wall assembly. The track includes an elongated flat web with first and second free-ended flanges extending in the same direction from opposed first and second side edges, respectively, of the web. Each flange of the web defines a plurality of spaced tabs extending toward the flat web from a free-end of each flange. The tool for connecting the stud in place and relative to the track includes a base. The tool also includes at least two pairs of bending arms each pivotally mounted to the base. Each pair of bending arms includes a first bending arm, adapted to be disposed to one side of the upright stud, and a second bending arm spaced apart from the first bending arm and adapted to be disposed to an opposite side of the stud. A mechanism is provided for moving at least one bending arm of each pair of bending arms from a first position and into engagement with a tab on each of the first and second free-ended flanges so as to bend opposed tabs on said first and second free-ended flanges engaged by the bending arms toward a center of the elongated track whereby inhibiting movement of said stud therepast. A method for securing a stud in place relative to a track is also disclosed.

26 Claims, 11 Drawing Sheets

(56) References Cited

U.S. PATENT DOCUMENTS

| | | | | | |
|---|---|---|---|---|---|
| 4,509,357 | A | | 4/1985 | Zbornik | |
| 4,614,106 | A | * | 9/1986 | Forget | B21D 39/02 29/238 |
| 4,672,836 | A | * | 6/1987 | Wilkinson | B25B 27/14 72/458 |
| 5,125,259 | A | * | 6/1992 | Meyer | H01R 43/00 140/105 |
| 5,797,233 | A | | 8/1998 | Hascall | |
| 5,887,395 | A | | 3/1999 | Navarro et al. | |
| 6,484,980 | B2 | | 11/2002 | Medlin et al. | |
| 7,150,175 | B2 | | 12/2006 | Traub | |
| 7,553,203 | B2 | | 6/2009 | Anbo et al. | |
| 7,677,071 | B2 | | 3/2010 | Heirich | |
| 8,505,264 | B2 | | 8/2013 | Glisko | |
| 8,555,566 | B2 | | 10/2013 | Pilz et al. | |
| 9,551,148 | B2 | | 1/2017 | Pilz | |
| 2014/0117182 | A1 | | 5/2014 | Blackburn | |

* cited by examiner

METAL TAB BENDING TOOL AND METHOD FOR SECURING AN UPRIGHT STUD IN PLACE AND RELATIVE TO AN ELONGATED TRACK

FIELD OF THE INVENTION DISCLOSURE

This invention disclosure generally relates to a metal stud and track framing system for use in building construction and, more specifically, to a metal tab bending tool and a method for securing a metal stud relative to an elongated metal track of a wall system.

BACKGROUND

A wall assembly typically used in the construction industry primarily includes an elongated header track that is secured to a ceiling or overhead framework, an elongated lower track that is secured to the floor, and a plurality of vertical studs extending therebetween. Gypsum wall board members or other suitable sheathing materials, amongst other components, are usually fastened to the tracks and studs to form a closed wall assembly. To reduce the spread of fire while increasing the strength and enhancing termite resistance of such walls, building construction framing is increasingly moving toward use of steel rather than wood for the header track, lower track and studs.

The elongated metal header track and the elongated metal lower track typically have a generally U-shaped cross-sectional configuration defining an elongated channel sized to receive, accommodate and cover the ends of the studs. The header track and lower track each generally have an elongated generally flat web with first and second free-ended flanges extending in the same direction from first and second side edges, respectively, of the web. After the studs are placed in a vertical orientation into the channel of each track to extend between the elongated header track and elongated lower track, suitable fasteners are used on both sides of the wall to connect the stud to each track. In some designs, the header track and lower track are suitably configured to permit the wall studs to move generally orthogonally relative to the tracks. If the wall studs are rigidly secured to the to the track and not allowed to move freely in at least one direction, the stability of the wall and possibly the building may be compromised.

In one form, and as disclosed in more complete detail in U.S. Pat. No. 9,551,148 to D. A. Pilz, there is provided an elongated track having a plurality of bendable tabs arranged in side-by-side relation relative to each other along the length of each flange on the header track and lower track. Each bendable tab extends toward the generally flat web from a free-end of each flange. In one form, each flange is defined between a pair of slits or openings provided on opposite sides of each tab. In one embodiment, each tab extends about ½ inch to about one inch from the free-end of each flange.

After the studs are freely nested within and between the elongated upper header track and the lower header track in a vertical orientation, two tabs on each flange of both the header track and lower track of the elongated track are bent on adjacent but opposed sides of each stud whereby straddling and capturing the stud therebetween. Having the tabs extend along the length of each flange readily and easily permits locating the studs along the length of the wall in substantially any desired location. Moreover, capturing the stud between the bent tabs inhibits movement of the stud along the length of the header and lower tracks while permitting vertical movements of the studs relative to the header and lower tracks. As such, precise placement of the studs can be readily accommodated without undue hardship or effort.

The elongated tracks are typically formed from sheet steel and can be manufactured with standard roll steel with suitable tooling or on a brake press, for example. As such, the four tabs on the flanges take a directed effort to be bent or angled into position on opposed sides of each stud. Additionally, the height of various wall assemblies continue to increase to advantageously affect a desired spacious appearance. As such, and with increased wall heights, workers need to sometimes climb ladders to reach and bend the tabs on the header tracks. Typically, a worker will be required to individually strike or hit each of the tabs with a hammer or other suitable tool with some force to move or bend them into and angled position relative to the stud captured therebetween. As will be appreciated, this can be a time consuming and tedious process. Depending upon a number of factors including the time of day, the workers state of mind, and because all four tabs at the upper and lower end of each stud will usually be required to bent to secure each stud in place, the workers will inevitably sometimes miss the tab and strike the track or stud with the hammer by mistake. Of course, and albeit in error, missing the tab and inadvertently striking or hitting either track or the stud with the hammer can either damage the track, the stud or adversely affect the securement of the track to the other building structure. As will be appreciated, inadvertently striking the track or stud can cause the metal to bend and create a bump. As a result, when the drywall is installed over such a bump, the drywall can likewise bump up and undesirably flare outward from the framing.

In view of the above, there is a continuing need and desire for a tool which can readily and easily bend the tabs on a manufactured metal framing system simultaneously relative to each other so as to significantly reduce the time and effort required to complete construction of the wall assembly as well as a method of quickly and inexpensively securing an upright stud in place and relative to an elongated track.

BRIEF SUMMARY

In view of the above, there is provided a metal tab bending tool for securing an upright stud in place and relative to an elongated upper or lower track in the context of a wall assembly. The track includes an elongated generally flat web with first and second free-ended flanges extending in the same direction from opposed first and second side edges, respectively, of the web. Each flange of the web defines a plurality of spaced tabs extending toward the flat web from a free-end of each flange.

In accordance with one aspect of this invention disclosure the tool for connecting the stud in place and relative to the track includes a base. The tool also includes at least two pairs of bending arms each pivotally mounted to the base. Each pair of bending arms includes a first bending arm, adapted to be disposed to one side of the upright stud, and a second bending arm spaced apart from the first bending arm and adapted to be disposed to an opposite side of the stud. A mechanism is provided for moving at least one bending arm of each pair of bending arms from a first position and into engagement with a tab on each of the first and second free-ended flanges so as to bend opposed tabs on said first and second free-ended flanges engaged by the bending arms toward a center of the elongated track whereby inhibiting movement of said stud therepast.

Preferably, the base of the tool includes a guide portion for positioning the tool relative to the upright stud and the flat web. In one form, the tool further includes an apparatus for spacing the stud a selected and predetermined distance from an adjacent stud. In a preferred embodiment, the mechanism of the tool simultaneously moves both bending arms of each pair of bending arms toward the center of the elongated track. In a preferred embodiment, the mechanism for the tool further includes structure for returning both bending arms of each pair of bending arms to the first position following the bending arms being moved into engagement with the opposed tabs on the first and second flanges of said elongated track.

In a preferred embodiment, the mechanism for the tool also includes a handle movable relative to the base of the tool. In one form, the mechanism further includes a transmission operably disposed between the movable handle and the bending arms for transferring movement of the handle to the bending arms.

In accordance with another aspect of this invention disclosure, the bending tool includes a base configured to locate the tool relative to the upright stud and the flat web. In accordance with this aspect of the invention disclosure the bending tool also includes first and second pairs of bending arms each pivotally mounted to the base. Each pair of bending arms includes a first bending arm adapted to be disposed to one side of the upright stud and a second bending arm spaced apart from the first bending arm and adapted to be disposed to an opposite side of the stud. The first and second bending arms of the first pair of bending arms are laterally aligned with the first and second being arms of the second pair of bending arms. A mechanism is provided for simultaneously moving the first and second bending arms of each pair of bending arms from a first position and into engagement with spaced tabs on each of the first and second free-ended flanges so as to bend the spaced tabs engaged by the bending arms toward a center of the elongated web whereby straddling and entrapping the stud therebetween.

The base of the tool is preferably configured to include a guide portion for positioning said tool relative to said upright stud and said flat web. In one form, the tool furthermore includes an apparatus for spacing the stud a selected and predetermined distance from an adjacent stud. The mechanism of the tool includes structure for automatically returning both bending arms of each pair of bending arms to the first position following the bending arms being moved into engagement with the opposed tabs on the first and second flanges of the elongated track. In a preferred embodiment, the mechanism includes a handle movable relative to the base.

In a preferred form, the mechanism further includes a transmission operably disposed between the movable handle and the bending arms for transferring movement of the handle to the bending arms. The transmission for the mechanism preferably includes a pair of intermeshing gear segments arranged in operable combination with at least one of the bending arms on each pair of bending arms. In another form, the transmission for the mechanism preferably includes an apparatus for interconnecting the first bending arm on the first pair of bending arms with the first bending arm on the second pair of bending arms.

According to another aspect of this invention disclosure, the metal tab bending tool includes a base configured to position the tool relative to the upright stud and the flat web on the elongated track. According to this aspect, the tool also includes first and second pairs of bending arms each pivotally mounted to the base. Each pair of bending arms includes a first bending arm adapted to be disposed to one side of said upright stud and a second bending arm spaced from the first bending arm and adapted to be disposed to an opposite side of the stud. The first and second bending arms of the first pair of bending arms are laterally aligned with the first and second being arms of the second pair of bending arms. A force transfer mechanism is disposed between and for simultaneously moving the bending arms of each pair of bending arms from a first position and into engagement with tabs on each of said first and second free-ended flanges so as to bend the spaced tabs engaged by the bending arms toward a center of the elongated track whereby straddling and entrapping the stud therebetween.

In a preferred embodiment, the base of the tool includes a guide portion for locating the tool relative to the upright stud and the elongated flat web of the track. In one form, the tool further includes an apparatus for spacing the stud a selected and predetermined distance from an adjacent stud. The mechanism of the bending tool further includes structure for automatically returning both bending arms of each pair of bending arms to the first position following the bending arms being moved into engagement with the opposed tabs on the first and second flanges of the elongated track.

Preferably, the force transfer mechanism for the tool includes a handle operably connected to one of the bending arms and movable relative to the base. The force transfer mechanism furthermore preferably includes a transmission operably disposed between the movable handle and the bending arms for transferring movement of the handle to the bending arms. In one form, the force transfer mechanism transmission includes a pair of intermeshing gear segments arranged in operable combination with at least one of the bending arms on each pair of bending arms. Alternatively, the force transfer mechanism includes an apparatus for interconnecting one bending arm on the first pair of bending arms with the opposed bending arm on the second pair of bending arms.

Another aspect of this invention disclosure relates to a method or way for securing an upright stud in place and relative to an elongated track. The elongated track includes an elongated generally flat web with first and second free-ended flanges extending in the same direction from first and second opposed side edges, respectively, of the web. Each flange of said track defines a plurality of spaced tabs extending toward the web from a free-end of each flange. The tabs on the first flange of the elongated track are generally and laterally aligned with the tabs on the second flange of the elongated track. The method includes the step of: bending one of the tabs on each flange of the elongated track inwardly and simultaneously toward a center of the elongated track, with the tabs being bent being disposed immediately adjacent to one side of the stud whereby inhibiting movement of the stud therepast.

The method for securing an upright stud in place and relative to the elongated track can further include the step of: positioning a tool relative to the upright stud and the elongated track. In one form, the tool includes at least two pairs of bending arms. Each pair of bending arms includes a first bending arm adapted to be disposed to one side of the upright stud and a second bending arm spaced apart from the first bending arm and adapted to be disposed to an opposite side of the stud.

Preferably, the method for securing an upright stud in place and relative to the elongated track also includes the step of: bending a second tab on each flange of the elongated track inwardly and simultaneously toward a center of the elongated track. The second tabs being bent are disposed immediately adjacent an opposed side of the stud whereby the first and second tabs on each flange of the elongated track straddle and entrap the stud therebetween.

Still another aspect of this invention disclosure relates to a method or way for securing an upright stud in place and relative to both upper and lower elongated tracks. The elongated tracks each include an elongated generally flat web with first and second free-ended flanges extending in the same direction from first and second opposed side edges, respectively, of the web. Each flange of each track defines a plurality of spaced tabs extending toward the web from a free-end of each flange. The tabs on the first flange of each elongated track are generally and laterally aligned with the tabs on the second flange of that track. The method includes the step of: bending laterally aligned tabs on each flange of each elongated track inwardly and simultaneously toward a center of the respective track, with the tabs being bent being disposed immediately adjacent to one side of the stud whereby inhibiting movement of the stud therepast.

The method for securing an upright stud in place and relative to the elongated tracks can further include the step of: positioning tools relative to the upright stud and the elongated track web of each track. In one form, each tool includes at least two pairs of bending arms. Each pair of bending arms of each tool includes a first bending arm adapted to be disposed to one side of the upright stud and a second bending arm spaced apart from the first bending arm and adapted to be disposed to an opposite side of the stud.

Preferably, this method for securing an upright stud in place and relative to the elongated tracks also includes the step of: bending a second tab on each flange of each elongated track inwardly and simultaneously toward a center of the respective elongated track. The second tabs being bent are disposed immediately adjacent an opposed side of the stud whereby the first and second tabs on each flange of each elongated track straddle and entrap the stud therebetween.

DETAILED DESCRIPTION

Figure 1:
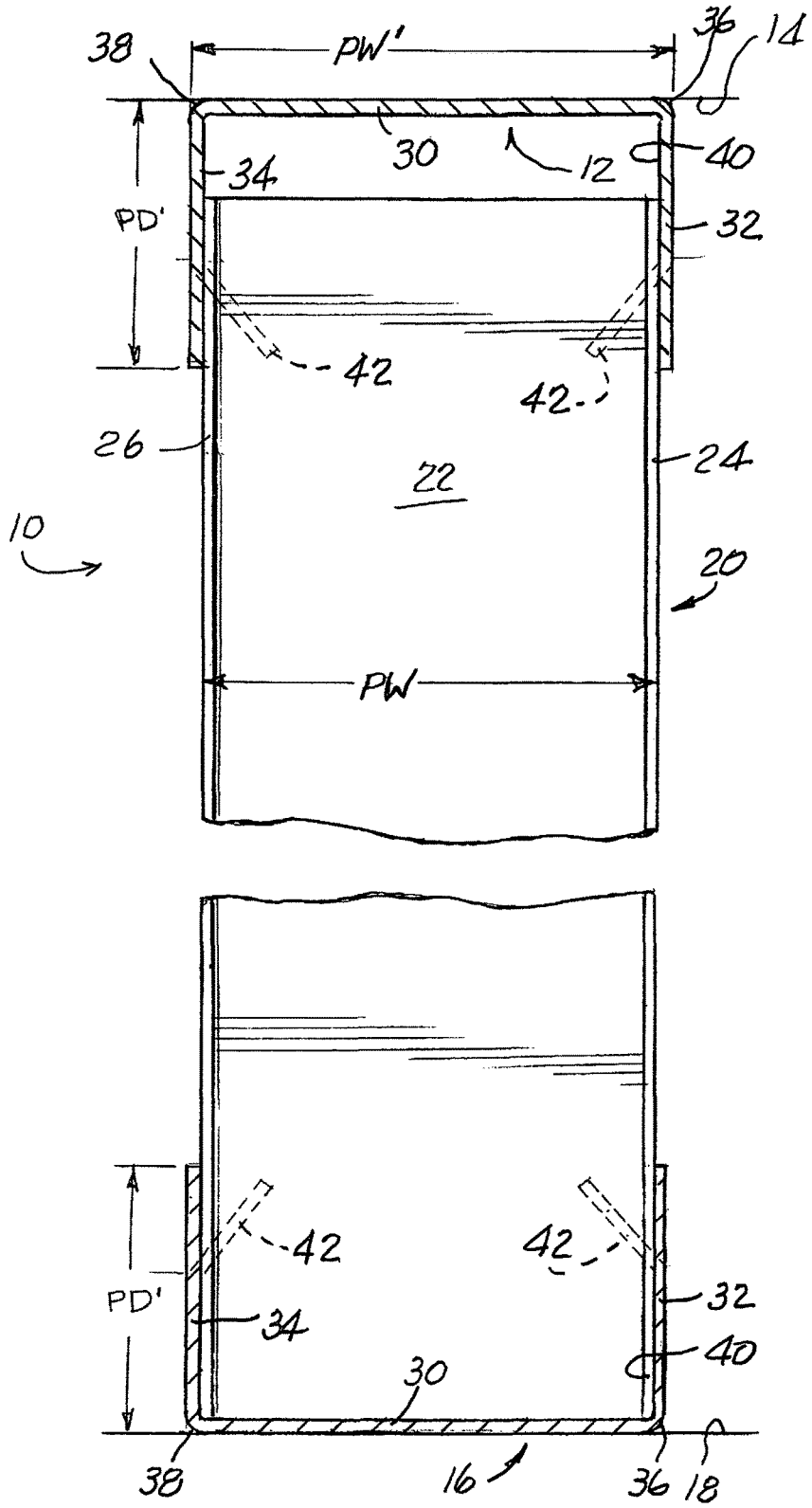
FIG. 1 is a fragmentary sectional view in elevation of a wall assembly having a metal header track and metal lower track with a stud extending therebetween and with which the present invention disclosure finds utility.

While this invention disclosure is susceptible of embodiment in multiple forms, there is shown in the drawings and will hereinafter be described preferred embodiments, with the understanding the present disclosure is to be considered as setting forth exemplifications of the disclosure which are not intended to limit the disclosure to the specific embodiments illustrated and described.

Referring now to the drawings, wherein like reference numerals indicate like parts throughout the several views, the metal tab bending tool of the present invention disclosure can advantageously be used in the construction of a manufactured wall assembly 10. As illustrated in FIG. 1, the wall assembly 10 typically includes a horizontally elongated upper metal track 12, adapted to be suitably secured to a ceiling 14, a horizontally elongated lower metal track 16, adapted to be suitably secured to a floor 18, and a plurality (with only one being shown in FIG. 1 for clarity) of spaced apart, upright metal studs 20 suitably configured to allow electrical, plumbing and other conduits to extend therethrough.

Figure 2:
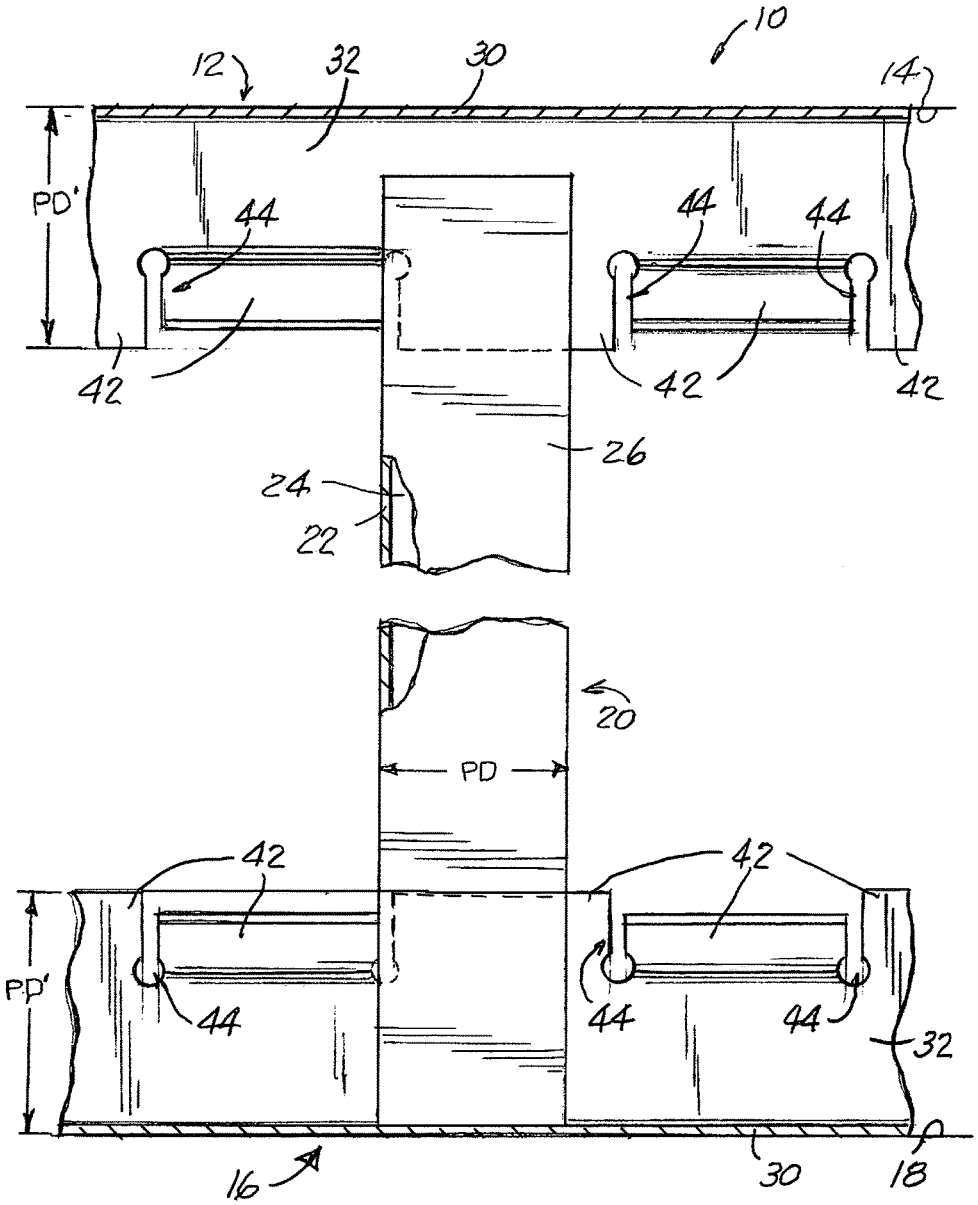
FIG. 2 is a fragmentary sectional view taken along line 2-2 of FIG. 1.

In the manufactured wall assembly 10 shown in FIG. 1, each stud 20 preferably has a standard generally channel shaped design and includes a generally planar stud web 22 extending along a vertical direction and a pair of laterally spaced stud flanges 24 and 26 extending in the same direction from and generally perpendicular to the stud web 22 for substantially the length of the stud. As illustrated in FIG. 2, the stud flanges 24 and 26 extend from the web 22 for a predetermined distance PD typically of about 1.250 inches. Moreover, and as shown in FIG. 1, each vertical stud 22 has a predetermined width PW.

In the manufactured wall assembly 10 illustrated in the drawings, the upper track 12 and the lower track 16 are identical relative to each other and are preferably made from a rigid but deformable galvanized steel material. It should be appreciated, however, other materials could be used without detracting or departing from the spirit and scope of this invention disclosure. As mentioned above, the upper track 12 and the lower track 16 are of the type shown and described in U.S. Pat. No. 9,551,148 to D. A. Pilz; the entirety of which is incorporated herein by reference.

Suffice it to say, and as shown in FIGS. 1 and 2, each metal track 12 and 16 includes an elongated generally flat web 30 with first and second free-ended flanges 32 and 34 extending in the same direction from opposed first and second side edges 36 and 38, respectively, of the web 30 so as to define an open-ended channel 40 therebetween. As shown in FIG. 1, the flanges 32 and 34 are laterally spaced apart by a predetermined width PW' which is approximately equal to the predetermined width PW of each stud 20. As further illustrated in FIGS. 1 and 2, the first and second free-ended flanges 32 and 34 extend in the same direction from the web 30 of each elongated track for a predetermined distance PD'.

Figure 3:
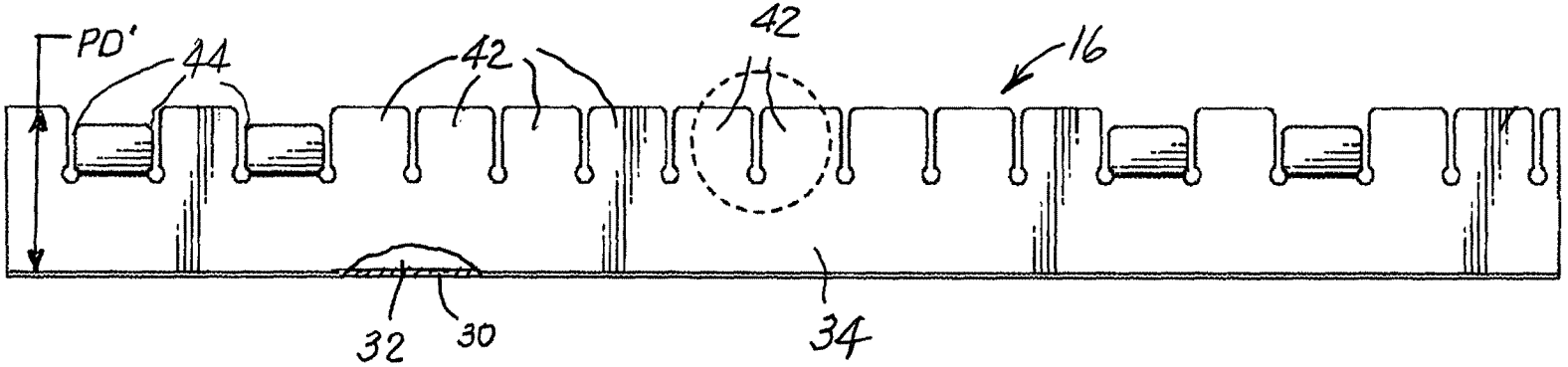
FIG. 3 is a side view of either the header track or lower track of the wall assembly illustrated in FIG. 1.

As shown in FIG. 3, each flange 32, 34 on the elongated track 12, 16 defines a plurality of side-by-side tabs 42 extending partially toward the web 30 from a free-end of each flange. Preferably, the tabs 42 on the flange 32 of each elongated track are generally aligned laterally with the tabs 42 on the flange 34 of each elongated track. In the form illustrated by way of example, the tabs 42 are formed to extend or continue generally along a plane defined by the flanges 32, 34. Each tab 42 is configured such that it can be folded or bent inwardly toward the center of the respective elongated track to secure one of the studs 20 (FIGS. 1 and 2) as discussed in greater detail below.

In a preferred form, the tabs 42 on each flange 32, 34 of the tracks 12 and 16 are of substantially equal length or height. Preferably, each tab 42 extends from the free end of the respective flange 32, 34 for a distance of about ½ inch. Accordingly, and with each flange 32, 34 extending for a predetermined distance PD of about 2 inches from the web 30, a distance of about 1.5 inches will separate a top of each tab 42 and the web 30.

Figure 4:
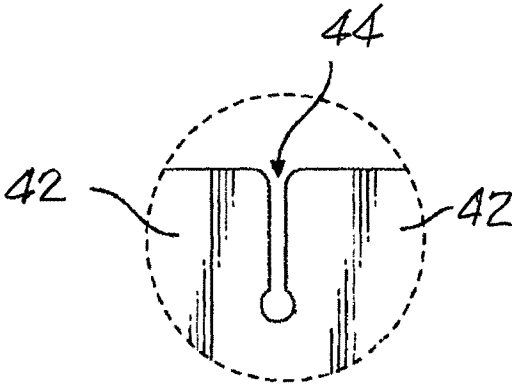
FIG. 4 is an enlarged view of the portion of track encircled in dash lines in FIG. 3.

In a preferred embodiment shown in FIGS. 3 and 4, the flanges 32 and 34 on each track 12 and 16 define a series of slits and keyholes 44 that form the tabs 42 therebetween and allow the tabs 42 to be bent to receive and secure a metal stud 20 (FIG. 2) between adjacent tabs. As shown by way of example in FIG. 3, the slits 44 on each track 12 and 16 measure about 0.062 inch to about 0.125 inch wide and are disposed on opposed sides of each tab 42. The slits 44 are spaced apart approximately 1.750 inch on center, starting at the free end of each flange 32, 34 and extend toward the web 30 along each flange 32, 34. One advantage of having the tab spacing being wider than the predetermined distance PD' (FIG. 2) each stud flange 24, 26 extends from the stud web 22 (FIG. 2) being this spacing allows the stud to be captured between the bent tabs while maintaining a limited degree of movement in either direction within the spacing between bent tabs. By preferably making the bent tab spacing about 0.125 inch to about 0.250 inch greater than the typical predetermined distance PD (FIG. 2) of each stud flange 24, 26, the installer can easily and readily shift the stud captured between the bent tabs to move slightly within the channel 40 of the track which can advantageously prove useful when drywall or other suitable sheathing is to be secured to the wall assembly 10. That is, the drywall installer needs the framing studs 20 to align with the center of the drywall board joints so the ability to move the studs 20, even slightly, without having to remove framing fasteners, i.e., screws or the like, can be very beneficial and tends to save labor costs while enhancing the drywall installation procedures.

The slits 44 preferably extend from the free-end of each flange 32, 34 toward the web 30 for approximately one-third the predetermined distance PD' each flange 32, 34 projects from the web 30 of the elongated track 12,16. That is, in a preferred embodiment, the slits 44 extend only partially along the predetermined distance PD' each flange 32, 34 of each track 12, 16 projects from the track web 30. As such, the bulk of each track 12, 16 (preferably that portion closet to the web 30) maintains a solid and uninterrupted C or U-shaped profile to inhibit sound, smoke or light from passing through the head-of-wall or bottom-of-wall interface with the ceiling or floor, respectively. Additionally, this design advantageously permits the drywall or other suitable sheathing material to be tight and flush against the wall framing members because no headed mechanical fasteners are required to attach the stud 20 to the tracks.

The tabs 42 on the flanges 32, 34 take a directed effort to be bent or angled into position on opposed sides of each stud 20. To ensure the tabs 42 are correctly bent into position to assure capturing the stud 20 straddled thereby, and to enhance the ability to correctly position and or bend the tabs 42 on opposed sides of the stud, especially on those header tracks of heightened wall assemblies, the present invention disclosure provides a metal tab bending tool 100 for accomplishing these desired ends. In operation, the metal tab bending tool 100 is used to secure each upright stud 20 of wall assembly 10 in place and relative to an elongated track 12, 16 (FIG. 1). In the embodiment shown by way of example in FIG. 5, the metal tab bending tool 100 includes a base 110 having a generally U-shaped configuration, in plan. In the example illustrated in FIG. 5, base 110 includes a pair of generally parallel disposed arms 112 and 114 which are rigidly interconnected by a third arm 116 to define an open-sided channel 118 therebetween. The channel 118 between the arms 112, 114 is configured to accommodate the flanged predetermined distance PD (FIG. 2) of the stud 20 therewithin.

Figure 5:
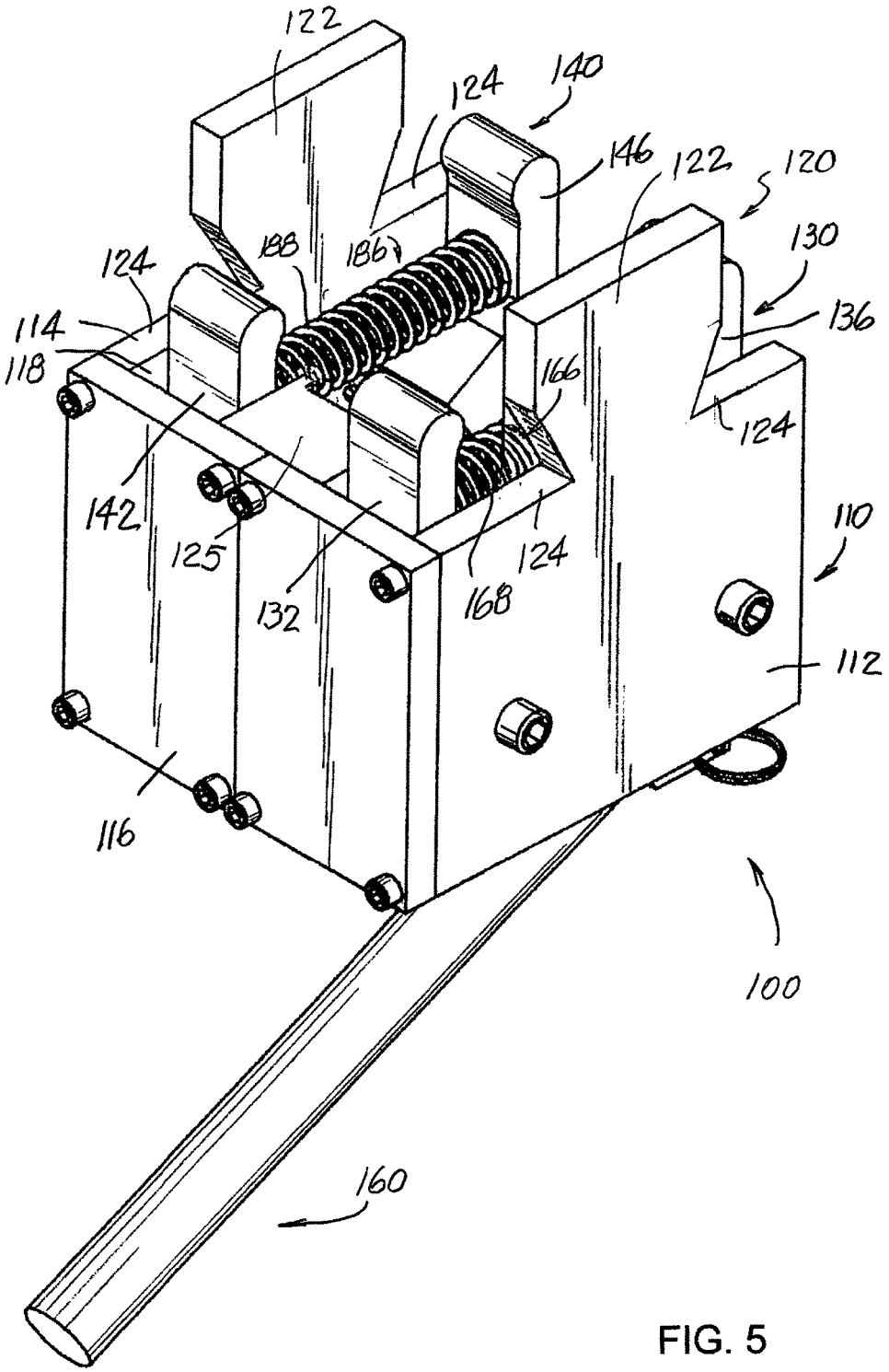
FIG. 5 is a perspective view of a metal tab bending tool embodying features and principals of the present invention disclosure.
Figure 6:
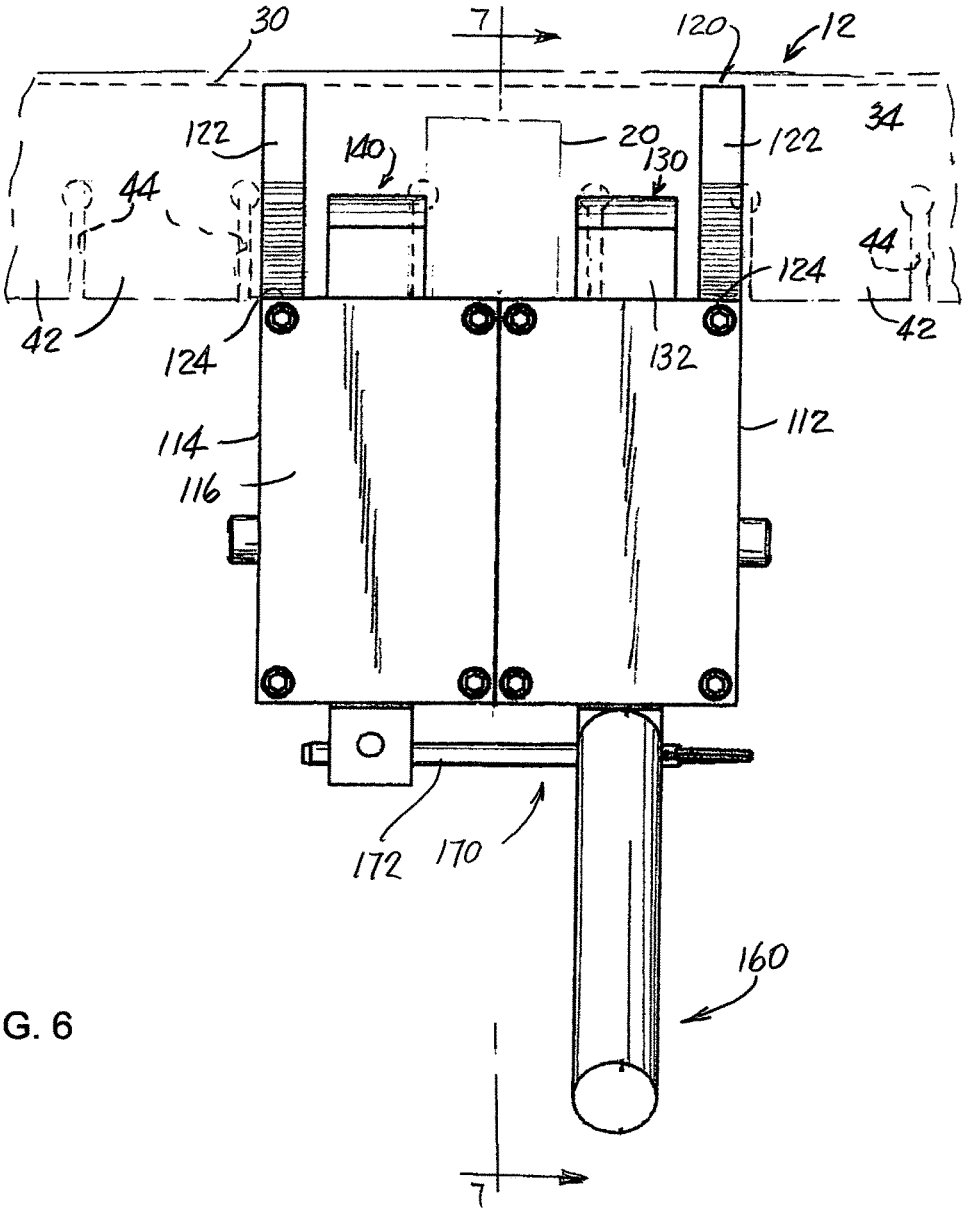
FIG. 6 is an elevational view of the metal tab bending tool illustrated in FIG. 5.
Figure 7:
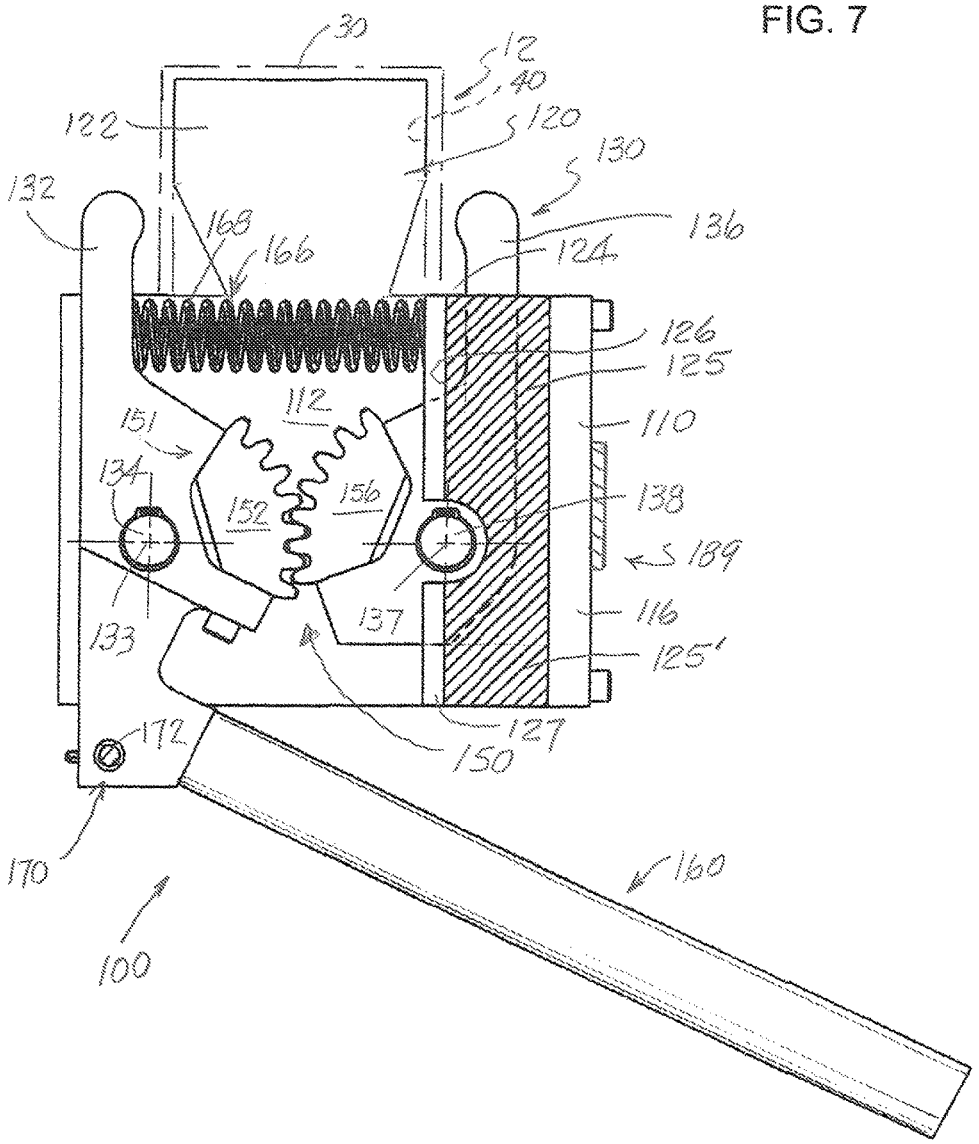
FIG. 7 is a sectional view taken along line 7-7 of FIG. 6.

In a preferred embodiment shown in FIGS. 5, 6 and 7, the base 110 of tool 100 further includes a guide portion 120. When the tool 100 is to be used to bend the tabs 42 (FIG. 4) on an elongated track, the guide portion 120 serves to position or locate the tool 100 relative to the upright stud 20 (FIG. 6) and the flat web 30 on the respective track. In one form, the guide portion 120 includes a free-ended extension 122 on each arm 112, 114. In the illustrated embodiment, the free-ended extension 122 on arm 112 is axially aligned with the free-ended extension 122 on arm 114. The free-ended extension 122 on each arm 112, 114 is configured to fit within the channel 40 (FIG. 7) defined by each track 12, 16 whereby orientating the tab bending tool 100 relative to the elongated track. Moreover, a surface 124 on each free-ended extension 122 is provided to further position or locate the tool 100 relative to the upright stud 20 and the flat web 30 on the respective track 12, 16.

Figure 8:
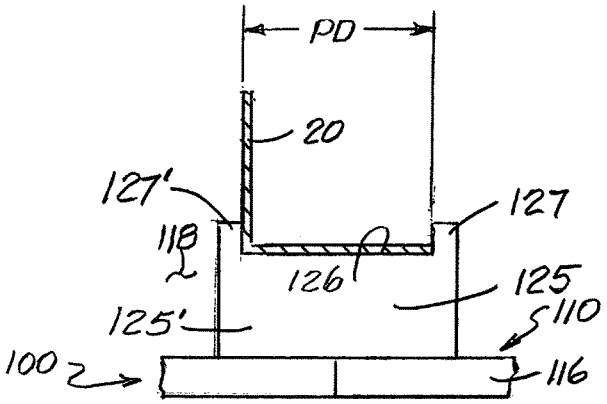
FIG. 8 is an enlarged fragmentary showing of a guide preferably used in operable combination with the metal tab bending tool.

In a preferred form, the guide portion 120 of tool 100 further includes a guide 125 carried by arm 116 of tool 100. In one form, guide 125 extends or projects into the open-sided channel 118 from wall 116 and defines an open-sided slot or channel 126. In the embodiment shown in FIG. 8, guide 125 includes a vertically elongated member 125' having a pair of spaced sides 127, 127' which define the open-sided slot or channel 126 therebetween. As illustrated in FIG. 8, the sides 127, 127' are spaced from each other by a distance equal to slightly greater than the predetermined distance PD of each stud 20 such that, during operation of tool 100, a stud 20 can be positioned, releasably captured and accommodated between the sides 127, 127' of guide 125 whereby ensuring proper positioning of the tool 100 relative to the stud 20.

Returning to the embodiment illustrated by way of example in FIGS. 5 and 6, the tab bending tool 100 furthermore includes at least two spaced pairs of bending arms 130 and 140 pivotally mounted on base 110. As schematically illustrated by way of example in FIG. 6, the spacing between the two pairs of bending arms 130 and 140 is approximately equal to the predetermined distance PD (FIG. 2) the stud flanges 24 and 26 extend from the stud web 22.

Turning to FIG. 7, the first pair of bending arms 130 includes a first free-ended pivotal bending arm 132 and a second free-ended bending arm 136 disposed in laterally aligned relation relative to each other. Between its ends, the first bending arm 132 is pivotally mounted to the base 110 for rotation about a fixed axis 133. A suitable stub shaft 134 carried by arm 112 of base 110 defines the fixed axis 133 about which arm 132 pivots. Between its ends, the second bending arm 136 is pivotally mounted to the base 110 for rotation about a fixed axis 137. Another suitable stub shaft 138 carried by arm 112 of base 110 defines the fixed axis 137 about which arm 136 rotates. The axes 133, 137 are disposed an equal distance from surface 122 on tool 100. Each bending arm 132, 136 is configured and the axes 133, 137 about which each bending arm 132, 136, respectively, pivots is disposed such that, upon operation of the tab bending tool 100, a free-end of each bending arm 132, 136 engages and simultaneously bends a tab 42 on the flange 32 of the elongated track along with a laterally aligned tab 42 on the flange 34 on the elongated track into the position schematically illustrated in FIG. 1. The tabs 42 being bent inwardly toward the center of the track (as shown in dash lines in FIG. 1) by bending arms 132 an 136 of the first pair of bending arms 130 are disposed to one or a common side of the upright or vertical stud 20 in a manner inhibiting movement of the stud past the bent tabs. The free-end of each arm 132, 136 is preferably configured to facilitate bending of the tabs 42 relative to the respective flange of the elongated track in response to forceful engagement of the tab by each bending arm 132, 136.

As illustrated by way of example in FIG. 5, the second pair of bending arms 140 includes a third free-ended pivotal bending arm 142 and a fourth free-ended bending arm 146. Preferably, the bending arms 142 and 146 are spaced from the bending arms 132 and 136 of the first pair of bending arms 130 by a distance slightly greater than the distance PD. The bending arms 142, 146 are disposed in laterally aligned relation relative to each other and disposed in substantially the same orientation relative to base 110 as are the first and second free-ended pivotal bending arms 132 and 136 of the first pair of bending arms 130. The third and fourth bending arms 142 and 146, respectively are pivotally mounted to arm 114 of base 110 in substantially the same manner as are arms 132, 136 to the arm 112 of base 110. The pivot axis for each arm 142, 146 of the second pair of bending arms 140 is disposed in general alignment with the pivot axis of each arm 132, 136, respectively. Suffice it to say, the pivot axes about which the bending arms 142, 146 pivot is disposed such that, upon operation of the tool 100, a free-end of each bending arm 142, 146 engages and simultaneously bends laterally aligned tabs 42 on opposed flanges 32, 34 of the track and disposed to opposite sides of the upright or vertical stud 20 inwardly toward a center of the stud whereby capturing the stud between the bent tabs on the elongated track. The free-end of each arm 142, 146 is preferably configured to facilitate positioning or bending of the tabs 42 relative to the respective flange of the elongated track in response to forceful engagement by the free-end of each bending arm 142, 146.

As illustrated in FIG. 7, the tab bending tool 100 of this invention disclosure further includes a mechanism 150 for effecting simultaneous movement of the two bending arms of at least one pair of bending arms from a first position and into engagement with laterally opposed and aligned tabs on each of the first and second free-ended flanges 32, 34 of the elongated track so as to position and bend the laterally opposed tabs on the first and second free-ended flanges 32, 34 of the track engaged by the bending arms toward a center of the elongated track whereby inhibiting movement of the stud therepast. In the embodiment illustrated by way of example in FIG. 7, mechanism 150 has a transmission 151 including a first gear segment 152, operably movable with the first bending arm 132, and arranged in intermeshing relationship with a second gear segment 156, operably movable with the second bending arm 136, such that movement of either bending arm 132, 136 results in simultaneous movement of the other bending arm. Preferably, the gear segments 152 and 156 are formed as part of the bending arms 132 and 134, respectively.

In the embodiment illustrated by way of example, mechanism 150 further includes an elongated operating handle 160 extending from and for transferring movement to the bending arms 132, 136 of the first pair of bending arms 130. Preferably, the transmission 151 of mechanism 150 is operably disposed between the operating handle 160 and the bending arms 132, 136 for transferring movement of the handle 160 to the bending arms 132, 136 of the first pair of bending arms 130. Moreover, the elongated configuration of the handle 160 arranged in depending relation from either bending arms 132, 136 facilitates placement and operation of the tab bending tool 100 in operable combination with the elongated header track 12 notwithstanding the height of the ceiling 14 from the floor 18.

As will be appreciated from a proper understanding of the metal tab bending tool 100 operation, movement of the handle 160 from the first position illustrated in FIG. 7 will forcibly result in displacement of the bending arms 132, 136 of the first pair of bending arms 130 simultaneously from the first position and inwardly toward each other whereby bending laterally opposed tabs 42 on the opposed flanges 32, 34 of the elongated track disposed to one side of the stud inwardly toward the center of the web 30 on the track as shown in FIG. 1.

In a preferred embodiment of the invention disclosure, the metal tab bending tool 100 further includes structure 166 for returning both bending arms 132, 136 of the first pair of bending arms 130 to the first position shown in FIG. 7 following the bending arms 132, 136 being moved into engagement with and bending the opposed tabs 42 on the first and second flanges 32 and 34, respectively of the elongated track. In the embodiment illustrated by way of example in FIG. 8, such structure 166 for returning both bending arms 132, 136 of the first pair of bending arms 130 to the first position includes a spring 168 operably disposed between the bending arms 132, 134 above the pivot axis 133 and 137, respectively, for each bending arm 132, 134. Of course, alternative devices for automatically returning both bending arms 132, 136 of the first pair of bending arms 130 to the first position after the bending arms 132, 136 move the opposed tabs 42 on the first and second flanges 32 and 34, respectively, of the elongated track into a bent or angled position relative to the remaining portion on the flanges 32 and 34 are equally applicable without detracting or departing from the spirit and scope of this invention disclosure.

Preferably, and to further reduce the time and effort required to bend opposed tabs 42 on the opposed flanges 32, 34 disposed to an opposed side of the stud 20 whereby capturing the stud 20 between bent tabs on each side thereof, the metal tab bending tool 100 can be easily and readily configured such that the third and fourth bending arms 142, 144 of the second pair of bending arms 140 are moved conjointly relative to each other and simultaneously with the first and second bending arms 132 and 134, respectively, of the first pair of bending arms 130. To accomplish these desired ends, and in a preferred embodiment of the invention disclosure, the second pair of bending arms 140 are designed as substantial mirror images of the first pair of bending arms 130.

That is, in a preferred embodiment, the third and fourth bending arms 142 and 146, respectively, of the bending tool 100 are interconnected to each other by a mechanism, similar to mechanism 150, for effecting simultaneous movement of both bending arms 142, 146 of the second pair of bending arms from a first position and into engagement with the tabs on each of the first and second free-ended flanges 32, 34 of the elongated track so as to bend laterally opposed tabs on the first and second free-ended flanges 32, 34 of the track engaged by the bending arms 142, 146 toward a center of the elongated track whereby inhibiting movement of the stud therepast. As mentioned, the mechanism for simultaneously moving both bending arms 142 and 146 includes intermeshing gear segments like those mentioned above regarding the first pair of bending arms 132 and 136. As such, movement of either bending arm 142, 146 results in simultaneous movement of the other bending arm.

To still further reduce the time and effort required to bend and position opposed tabs 42 on the flanges 32, 34 of either track 12, 16 (FIG. 1) disposed to both sides of the stud 20 whereby capturing the stud 20 between bent tabs on each side thereof, the metal tab bending tool 100 is preferably provided with a force transfer assembly 170 preferably disposed between the first and second pairs of bending arms 130 and 140, respectively.

In the form shown by way of example in FIG. 6, the force transfer assembly 170 includes an elongated connector 172 extending between and operably connecting a bending arm of each pair of bending arms 130 and 140. The connector 172 readily permits transference of forces and movements between one bending arm of the first pair of bending arms and a similarly situated bending arm of the second pair of bending arms. It should be appreciated, the force transfer assembly 170 can take different forms from that shown and described without detracting or departing from the spirit and scope of this invention disclosure.

When the operating handle 160 is actuated to move bending arm 132 of the first pair of bending arms 130, movement of the bending arm 132 is conjointly transferred to bending arm 142 of the second pair of bending arms 140 by the force transfer assembly 170. As will be appreciated from an understanding of the operation of tool 100, movement of the bending arm 132 will likewise be simultaneously transferred to bending arm 136. Similarly, movement of the bending arm 142 will likewise be simultaneously transferred to bending arm 146. As a result of all four bending arms 132, 136 and 142, 146 being conjointly operated, two laterally opposed tabs 42 on each of the flanges 32, 34 of the elongated track are simultaneously bent into the position shown in dash lines in FIG. 1 and on opposite sides of the stud so as to straddle the stud 20 therebetween whereby securing the stud relative to the elongated track.

In the embodiment illustrated in FIG. 5, the metal tab bending tool 100 further includes structure 186 for facilitating return of both bending arms 142, 146 of the second pair of bending arms 130 to the first position shown in FIG. 5 following the bending arms 142, 146 being moved into engagement with the opposed tabs 42 on the first and second flanges 32 and 34, respectively of the elongated track. In the embodiment illustrated by way of example in FIG. 5, such structure 186 for automatically returning both bending arms 142, 146 of the second pair of bending arms 140 to the first position includes a spring 188 operably disposed between the bending arms 142, 146 above the pivot axis for each bending arm 142, 146. Of course, alternative devices for automatically returning both bending arms 142, 146 of the second pair of bending arms 140 to the first position after the bending arms 142, 146 move the opposed tabs 42 on the first and second flanges 32 and 34, respectively of the elongated track into a bent or angled position relative to the remaining portion on the flanges 32 and 34 are equally applicable without detracting or departing from the spirit and scope of this invention disclosure.

Figure 9:
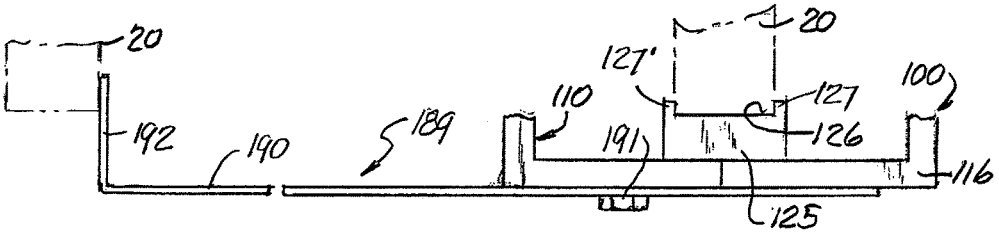
FIG. 9 is fragmentary illustration of one form of mechanism preferably used in operable combination with the metal tab bending tool for facilitating proper spacing or distances between adjacent studs.

To facilitate proper spacing between adjacent studs 20, the tool 100 of the present invention disclosure furthermore preferably includes an apparatus 189 including a spacer bar 190. In the embodiment illustrated by way of example in FIG. 9, the spacer bar 190 of apparatus 189 has an elongated configuration and is releasably secured to and extends sideways away from tool 100 and toward an adjacent stud. In a preferred form, the spacer bar 190 is releasably secured, as with a releasable fastener or the like 191, to extend sideways away from tool 100 toward an adjacent stud. At a free distal end thereof, the spacer bar 190 is provided with an extension 192 which is configured to engage and abut with the next adjacent stud 20. In one form, the extension 192 is disposed a predetermined distance from either side 127, 127' on guide 125 defining the slot or channel 126 for releasably accommodating a stud 20. That is, the predetermined distance the extension 192 is disposed from the channel 126 can be a predetermined selected distance such that adjacent studs on the wall assembly 10 (FIG. 1) can be consistently and accurately positioned with 8 inches, 12 inches, 16 inches, 20 inches, 24 inches or other suitable spacing apart from each other without requiring a separate measurement each and every time the studs are to be positioned and secured to either track 12, 16 of the manufactured wall assembly 10 (FIG. 1). As such, and when the extension 192 of the spacer bar 190 abuts with the adjacent stud 20, the operator can be assured the stud being acted on by tool 100 will be set with a selected and predetermined distance spanning the distance between adjacent studs.

Figure 10:
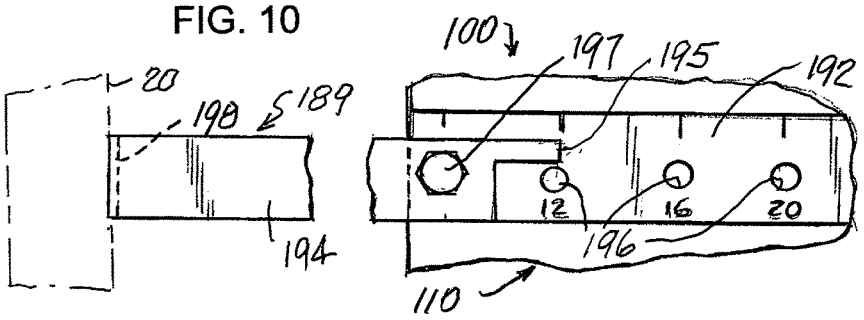
FIG. 10 is an enlarged fragmentary illustration of another form of mechanism preferably used in operable combination with the metal tab bending tool for facilitating proper spacing or distances between adjacent studs.

Another embodiment of mechanism 189 is illustrated by way of example in FIG. 10. In the embodiment illustrated by way of example in FIG. 10, apparatus 189 includes a mount 192 and a second piece 194 slidably movable relative to the mount 190. In this embodiment, mount 194 is suitably secured to and extends sideways from tool 100 toward an adjacent stud. In the embodiment illustrated in FIG. 10, mount 192 is provided with markings and indicia thereon indicative of the intended spacing between adjacent studs and the second piece 194 is provided with an indicator 195. Moreover, the mount 192 is provided with a series of spaced threaded openings 196 which allow a fastener 197 to secure the second piece 194 relative to the mount 192 and in any one of the openings 196. At a free distal end thereof, the second piece 194 is provided with an extension 198 which is configured to engage and abut with the next adjacent stud 20. As will be appreciated, the second piece 194 of apparatus 189 can be slidably moved relative to the mount 192 until the indicator 195 on the second piece 194 is positioned relative to the indicia on the mount 192 indicative of the desired spacing between the studs 20. Thereafter, the fastener 197 is used to releasably secure the second piece 194 relative to the mount 192. As such, and when the extension 198 of the second piece 194 abuts with the adjacent stud 20, the operator can be assured the stud being acted on by tool 100 will be set with a selected predetermined distance spanning the distance between adjacent studs.

Figure 11:
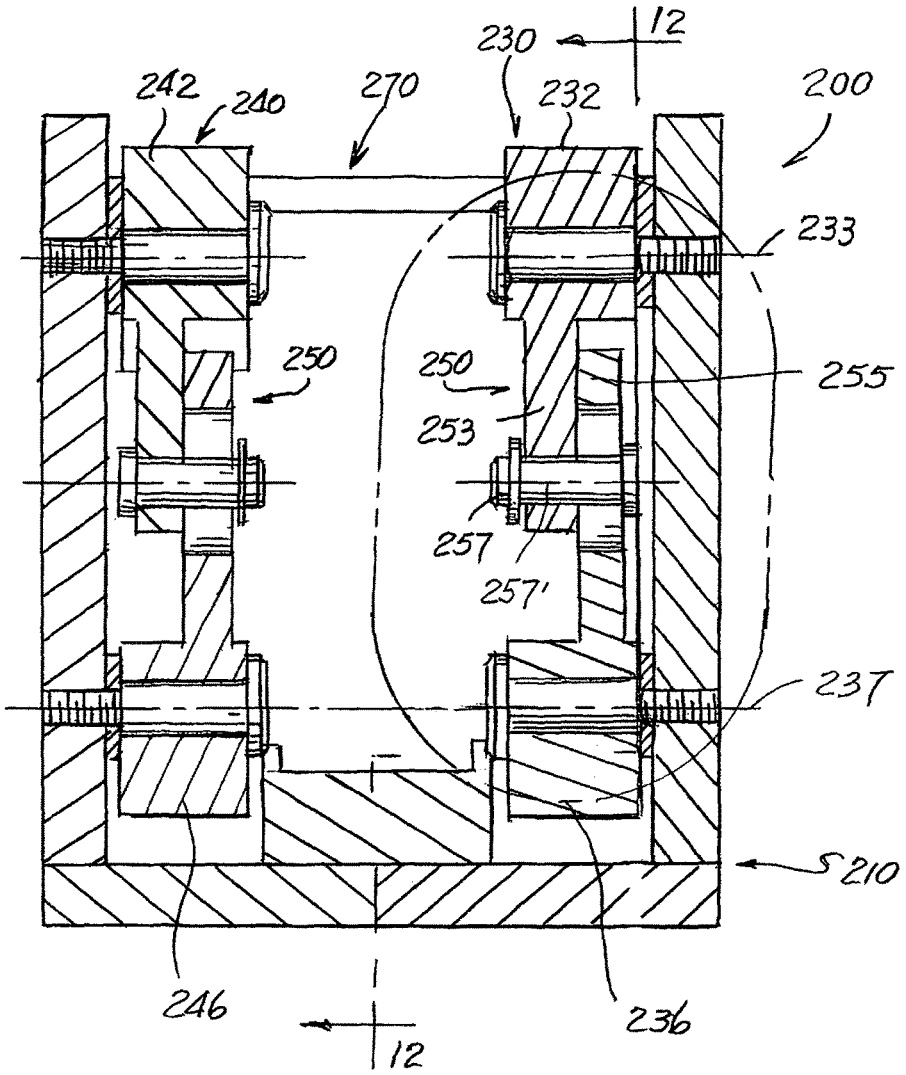
FIG. 11 is a sectional view of another embodiment of a metal tab bending tool incorporating features and principals of the present invention disclosure.
Figure 12:
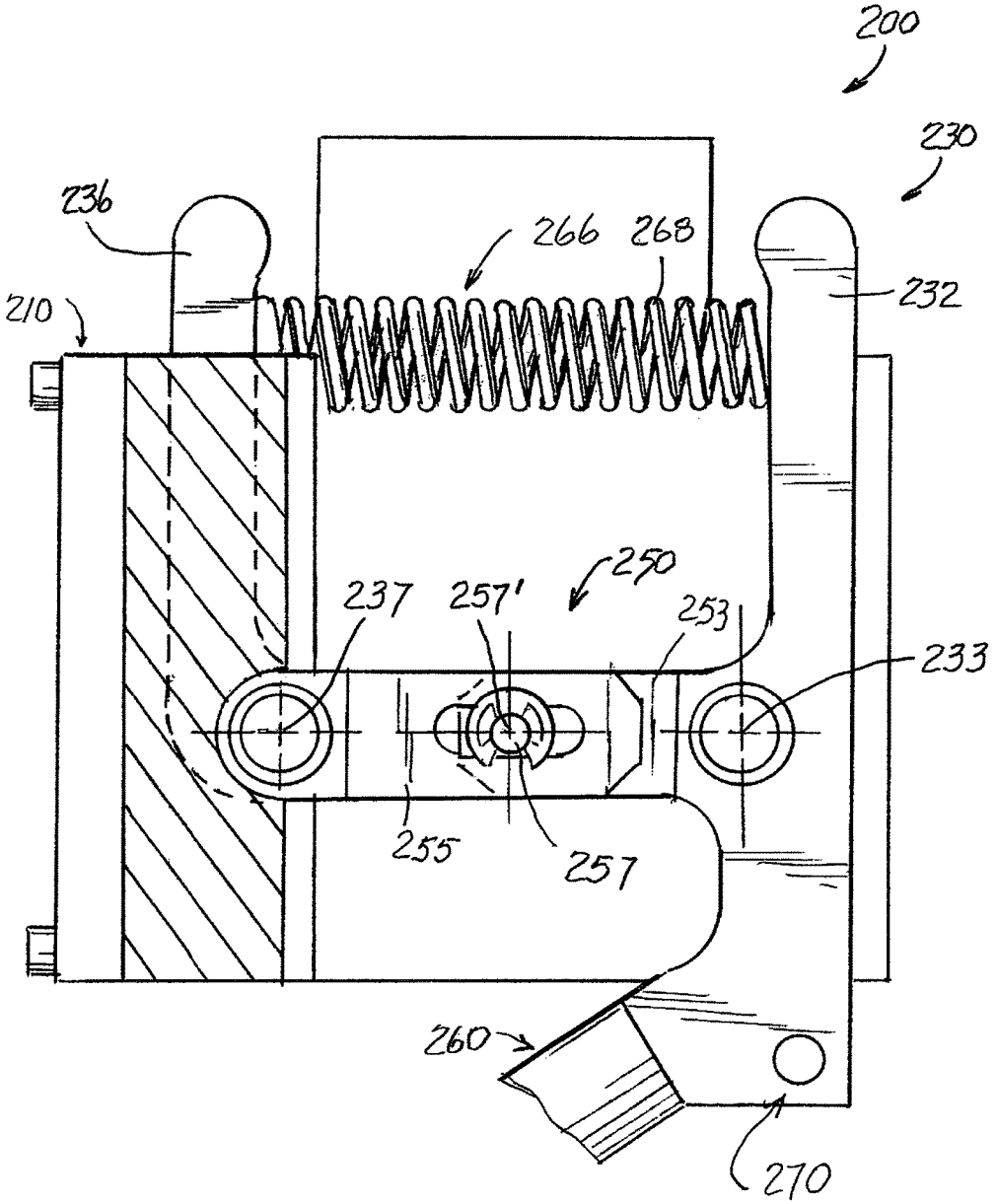
FIG. 12 is a sectional view taken along line 12-12 of FIG. 11.
Figure 13:
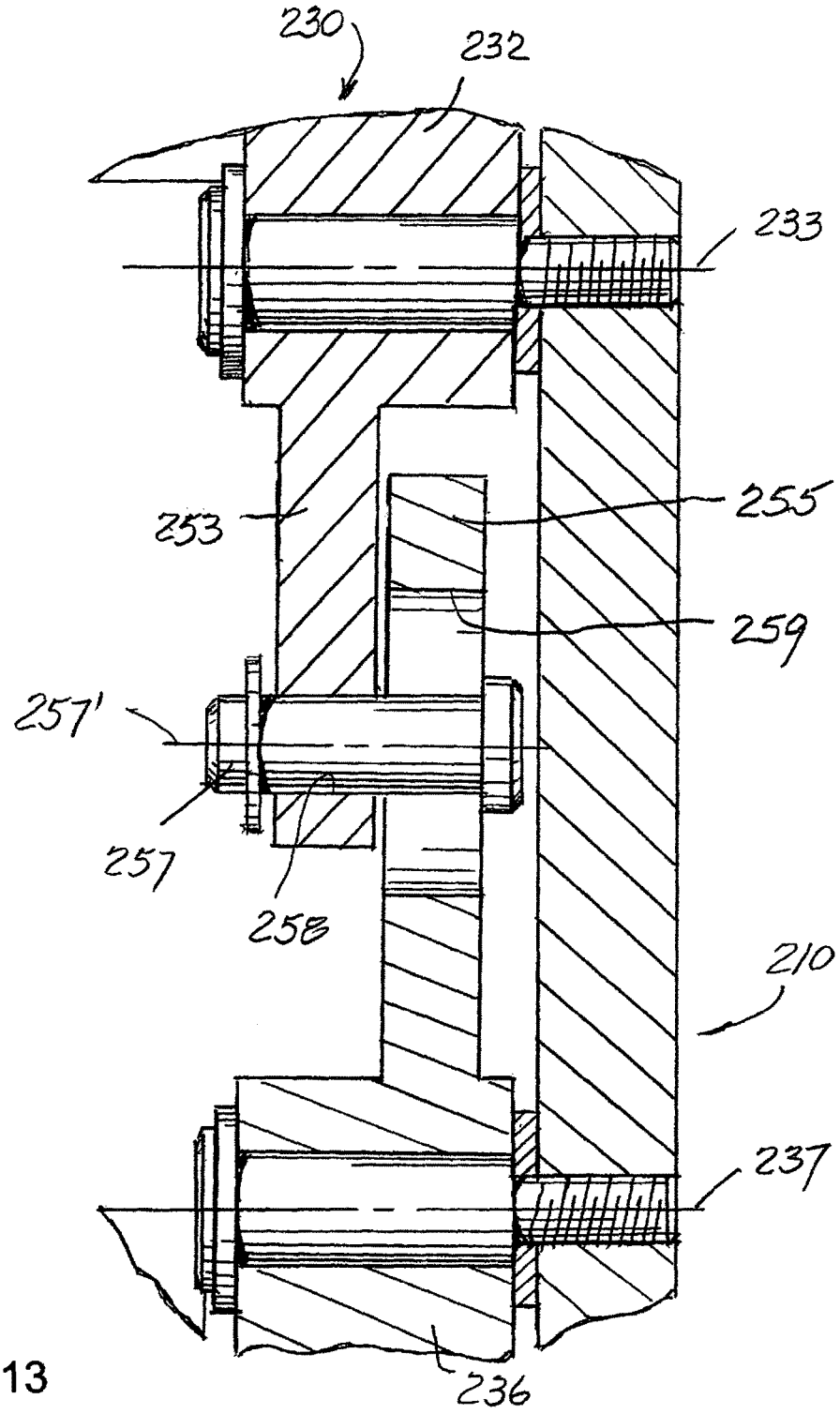
FIG. 13 is an enlarged view of the area encircled in phantom lines in FIG. 11.

Another embodiment of a metal tab bending tool having an alternative force transfer mechanism for effecting simultaneous movement of at least one bending arm of each pair of bending arms from a first position and into engagement with laterally opposed tabs on each of the first and second free-ended flanges 32, 34 (FIGS. 1 and 2) of the elongated track so as to bend and position such laterally opposed tabs on the first and second free-ended flanges 32, 34 of the track toward a center of the elongated track is illustrated in FIGS. 11, 12 and 13. This alternative form of force transfer mechanism for the bending tool is designated generally by reference numeral 250. The elements of this alternative form of tool and force transfer mechanism that are identical or functionally analogous to those components or elements of tool 100 and mechanism 150 discussed above are designated with reference numerals identical to those used above with the exception this alternative embodiment of force transfer mechanism uses reference numerals in the 200 series.

The alternative tool 200 illustrated in FIG. 11 includes first and second pairs of bending arms 230 and 240 which are pivotally mounted on a base 210 in a manner substantially similar to that discussed above regarding the pairs of bending arms 130 and 140. As illustrated by way of example in FIGS. 11 and 12, the alternative form of force transfer mechanism 250 involves providing each of the laterally aligned bending arms 232 and 236 with parallel extending, free-ended projections 253 and 255, respectively, which extend toward each other and toward a center of the tab bending tool 200. Preferably, and like bending arm 132 discussed above, the bending arm 232 of the first pair of bending arms 230 pivots about a fixed axis 233. Similarly, and like bending arm 136 discussed above, the bending arm 236 of the first pair of bending arms 230 preferably pivots about a fixed axis 237. As illustrated by way of example in FIG. 12, the free-ended projections 253 and 255 on arms 232 and 236 extend in opposed directions relative to each other, away from and at a preferably orthogonal direction relative to the respective bending arm. As shown in FIGS. 11 and 13, free ends of the projections 253 and 255 extend past and in proximate relation relative to each other.

As shown in FIGS. 11, 12 and 13, along their lengths and preferably toward their free ends, the parallel projections 253 and 255 are slidably interconnected to each other by a pin 257. Upon operation of the tool 200, and to optimize the pivotal movements at the free end of each bending arms 232 and 236 toward each other and toward a center of tool 200, the axis 257' of pin 257 is preferably disposed on the same datum as a line or plane passing between the pivotal axes 233 and 237 for the arms 232 and 236 when the arms 232 and 236 are disposed in the first position illustrated in FIG. 12.

In the embodiment illustrated in FIG. 13, the projection 253 on bending arm 232 defines a throughbore or opening 258 having a diameter proximately equal to the diameter of the pin 257 passing therethrough. In the embodiment illustrated in FIG. 13, the projection 255 on bending arm 236 defines an elongated slot or groove 259 through which pin 257 passes. The elongated slot or groove 259 extends in generally the same direction as the projection 255 on bending arm 236. The elongated slot or groove 259 defined by projection 255 has a width about equal or slightly greater than the diameter of pin 257 but has a length greater than the diameter of pin 257. Notably, and after tool 200 is arranged in working order, pin 257 is configured such that it is permitted to slide or move within the slot or groove 259 but cannot inadvertently endwise escape therefrom.

Returning to the embodiment illustrated by way of example in FIG. 12, mechanism 250 further includes an elongated operating handle 260 extending from and for imparting movement to the bending arms 232, 236 of the first pair of bending arms 230. The elongated configuration of the handle 260 arranged in depending relation from either bending arms 232, 236 facilitates placement and operation of the tab bending tool 200 in operable combination with the elongated header track 12 notwithstanding the height of the ceiling 14 from the floor 18 (FIG. 1).

As will be appreciated from a proper understanding of the metal tab bending tool 200 operation, movement of handle 260 from the first position illustrated in FIG. 12 will forcibly result in displacement of the bending arms 232, 236 of the first pair of bending arms 230 simultaneously from the first position and inwardly toward each other whereby bending laterally aligned tabs on the opposed flanges of the elongated track inwardly toward the center of the web on the track as shown in FIG. 1. That is, mechanism 250 of tool 200 effectively and efficiently transfers movement of the handle 260 into movement of the bending arm 232 along with the projection 253 and the pin 257 which slides within the groove 259 on the projection 255 associated with arm 236 and results in simultaneous forceful movement or pivotal displacement of the bending arm 236 inwardly toward a center of the tool 200.

In a preferred embodiment of the invention disclosure, metal tab bending tool 200 further includes structure 266 for returning both bending arms 232, 236 of the first pair of bending arms 230 to the first position, shown in FIG. 12, following their displacement or movement from the first position by handle 260 and following the bending arms 232, 236 being moved into engagement with the laterally opposed and aligned tabs on the first and second flanges of the elongated track. In the embodiment illustrated by way of example in FIG. 12, such structure 266 for automatically returning both bending arms 232, 236 of the first pair of bending arms 230 to the first position includes a spring 268 operably disposed between the free ends of the bending arms 232, 234 above the pivot axis 233 and 237, respectively, for each. As mentioned above, alternative devices for automatically returning both bending arms 232, 236 to the first position illustrated in FIG. 12 following their displacement are equally applicable without detracting or departing from the spirit and scope of this invention disclosure.

Returning FIG. 11, the second pair of pivotal bending arms 240 includes a third free-ended pivotal bending arm 242 and a fourth free-ended pivotal bending arm 246 disposed in laterally aligned relation relative to each other and disposed in substantially the same orientation relative to base 210 as are the first and second free-ended pivotal bending arms 232 and 236 of the first pair of bending arms 230. Preferably, the bending arms 242 and 246 are substantially similar in design and mirror images of the bending arms 232 and 246. As illustrated by way of example in FIG. 11, the bending arms 242 and 246 of the second pair of bending arms are operably interconnected by the alternative form of force transfer mechanism 250 similar to that described in detail above. As such, movement of either bending arm 242, 246 will result in simultaneous pivotal movement of the other bending arms of the second pair of bending arms.

As with tool 100, and to further reduce the time and effort required to bend and position laterally opposed tabs on the opposed flanges of the elongated track disposed to both sides of a stud whereby effectively and efficiently capturing a stud between bent tabs on each side thereof, the metal tab bending tool 200 is preferably configured such that the third and fourth bending arms 242, 246 of the second pair of bending arms 240 are moved conjointly relative to each other and simultaneously with the first and second bending arms 232 and 236, respectively of the first pair of bending arms 230. To accomplish these desired ends, and like tool 100, tool 200 includes a force transfer assembly 270 preferably disposed between the first and second pairs of bending arms 230 and 240, respectively. In this embodiment, the force transfer assembly 270 is substantially similar to the force transfer assembly 170 described in detail above. It should be appreciated, however, the force transfer assembly 170 can take different forms from that shown and described without detracting or departing from the spirit and scope of this invention disclosure.

When the operating handle 260 (FIG. 12) is actuated to operate the first pair of bending arms 230, movement of the bending arm 232 is conjointly transferred to bending arm 242 of the second pair of bending arms 240 by the force transfer assembly 270. As will be appreciated from an understanding of the operation of tool 200, movement of the bending arm 232 will likewise be simultaneously transferred to arm 236 by the force transfer mechanism 250. Similarly, movement of the bending arm 242 will likewise be simultaneously transferred to arm 246 by the force transfer mechanism 250 disposed therebetween. As a result of all four arms 232, 236 and 242, 246 being conjointly operated, two laterally opposed tabs on each of the flanges of the elongated track are simultaneously bent into the position shown in dash lines in FIG. 1 and on opposite sides of the stud so as to straddle the stud therebetween whereby securing the stud relative to the elongated track.

To further reduce the efforts required to easily and quickly manufacture the structure of wall assembly 10, another aspect of this invention disclosure involves bending the tabs on both the upper track 12 and lower track 16 of the wall assembly 10 (FIG. 1) simultaneously relative to each other. To accomplish these desired ends, and as schematically illustrated by way of example in FIG. 14, the present invention disclosure envisions arranging two vertically disposed tools 100 and 100' embodying both the principals and teachings of either tool 100 or tool 200 discussed above in operable combination with each of the upper track 12 and lower track 16, respectively, of wall assembly 10. Suffice it to say, the tools 100 and 100' are substantially the same as tool 100/200 discussed in detail above but with some slight modifications made thereto whereby allowing both tools 100 and 100' to be preferably operated and function in concert relative to each other to accomplish the desired results.

Figure 14:
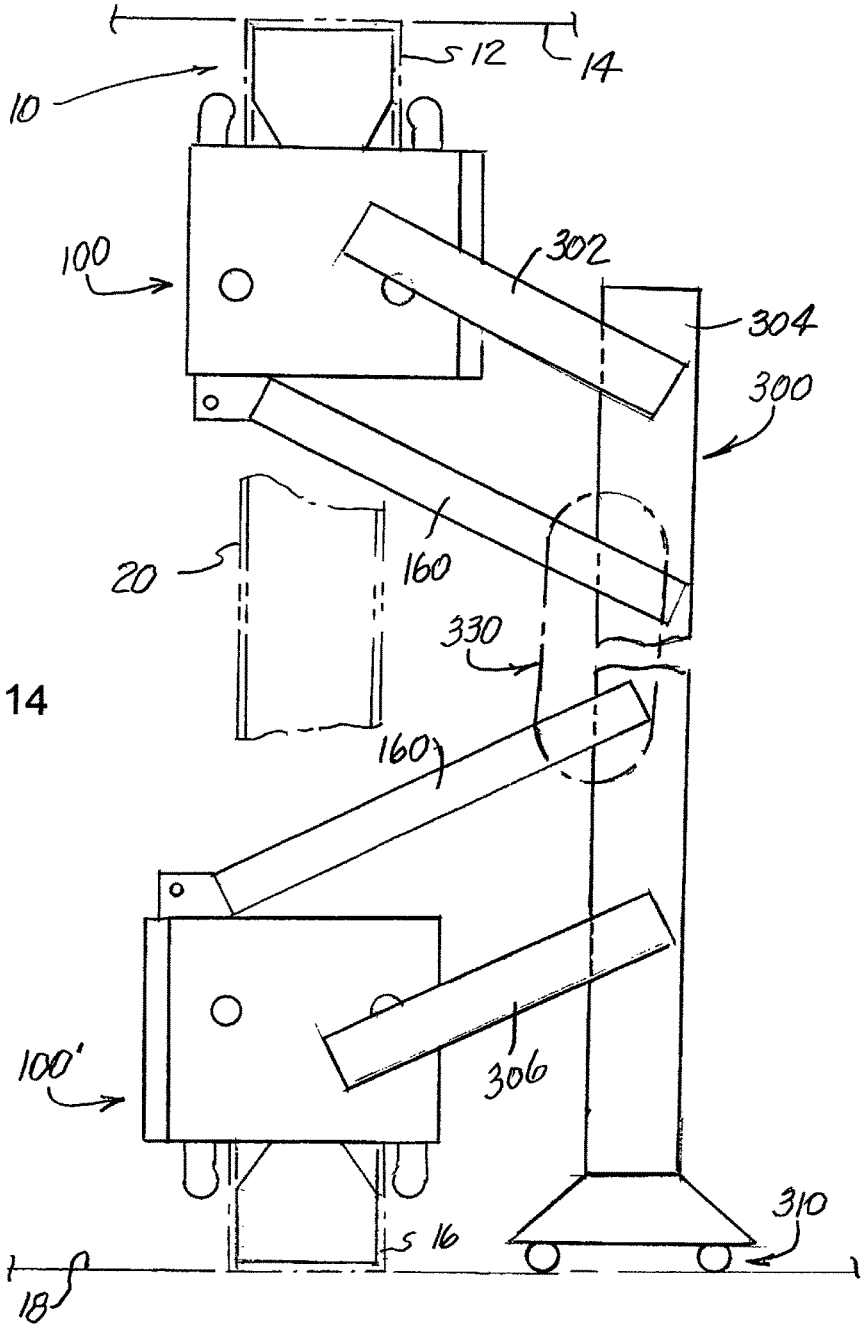
FIG. 14 is schematic illustration of how both the upper and lower tracks of a manufactured wall assembly can be operated upon simultaneously relative to each other.

As schematically illustrated by way of example in FIG. 14, a portable and generally vertical stand 300 is used to arrange and/or position each tool 100, 100' in operable combination with the upper track 12 and lower track 16 simultaneously relative to each other. In the illustrated embodiment, a suitable connector 302 extends from a mast 304 of the stand 300 and is used to position tool 100 relative to the upper track 12. In the illustrated embodiment, another suitable connector 306 extends from the mast 304 of stand 300 and is used to position tool 100' relative to the lower track 16. To facilitate movement thereof when desired or as needed, the stand 300 is preferably provided with suitable structure 310, such as wheels and/or rollers or the like, for promoting movements of the stand 300 between locations.

In a preferred arrangement illustrated by way of example in FIG. 14, the operating handle 160 of each tool 100, 100' are operably joined to each other by an actuating mechanism 330. The actuating mechanism 330 comprises any number of elements and interconnecting components required to simultaneously operate the handle 160 of each tool 100, 100' in concert relative to each other. Suffice it to say, operation of mechanism 330 simultaneously operates each tool 100, 100' whereby causing four tabs on the upper track 12 to be bent into position simultaneously with four tabs on the bottom track 16 being bent into position to releasably capture and maintain a stud therebetween in the manner discussed in detail above. Of course, less than four tabs on each of the upper track 12 and lower track 16 can be bent simultaneously without detracting or departing from the spirit and scope of this aspect of the invention disclosure. Alternatively, the operating handle 160 of each tool 100, 100' could be operated independently rather than conjointly relative to each other, if so desired, without detracting or departing from the spirit and scope of this invention disclosure.

The present invention disclosure also includes a method or way for securing an upright stud in place and relative to an elongated track. The elongated track including an elongated generally flat web with first and second free-ended flanges extending in the same direction from first and second opposed side edges, respectively, of the web. Each flange of the elongated track defines a plurality of side-by-side tabs extending toward the web from a free-end of each flange. The tabs on the first flange of the elongated track are generally laterally aligned with the tabs on the second flange of the track. The method includes the step of: bending laterally aligned tabs on each flange of the elongated track inwardly and simultaneously toward a center of the elongated track. The tabs being bent are disposed immediately adjacent to one side of the stud whereby inhibiting movement of the stud therepast.

The method for securing an upright stud in place and relative to the elongated track can further include the step of: positioning a tool relative to the upright stud and the elongated track. In one form, the tool includes at least two pairs of bending arms. Each pair of bending arms includes a first bending arm adapted to be disposed to one side of the upright stud and a second bending arm spaced apart from the first bending arm and adapted to be disposed to an opposite side of the stud.

Preferably, the method for securing an upright stud in place and relative to the elongated track also includes the step of: bending other laterally aligned tabs on the flanges of the elongated track inwardly and simultaneously toward a center of the elongated track. Wherein, the other laterally aligned tabs being bent are disposed immediately adjacent an opposed side of the stud whereby the bent tabs on each flange of the elongated track straddling and entrapping the stud therebetween.

To further reduce the efforts required to easily and quickly manufacture the structure of wall assembly 10, another aspect of this invention disclosure involves a method or way for securing an upright stud in place and relative to upper and lower tracks. Each elongated track includes an elongated generally flat web with first and second free-ended flanges extending in the same direction from first and second opposed side edges, respectively, of the web. Each flange of each elongated track defines a plurality of side-by-side tabs extending toward the web from a free-end of each flange. The tabs on the first flange of the each track are generally laterally aligned with the tabs on the second flange of the same track. The method includes the step of: bending laterally aligned tabs on each flange of each elongated track inwardly and simultaneously toward a center of the respective elongated track. The tabs being bent are disposed immediately adjacent to one side of the stud whereby inhibiting movement of the stud therepast.

The method for securing an upright stud in place and relative to the elongated tracks can further include the step of: positioning tools relative to the upright stud and the elongated tracks. In one form, each tool includes at least two pairs of bending arms. Each pair of bending arms of each tool includes a first bending arm adapted to be disposed to one side of the upright stud and a second bending arm spaced apart from the first bending arm and adapted to be disposed to an opposite side of the stud.

Preferably, the method for securing an upright stud in place and relative to the elongated tracks also includes the step of: bending other laterally aligned tabs on the flanges of the elongated tracks inwardly and simultaneously toward a center of the respective elongated track. Wherein, the other laterally aligned tabs being bent are disposed immediately adjacent an opposed side of the stud whereby the bent tabs on each flange of the elongated track straddle and entrap the stud therebetween.

From the foregoing, it will be observed that numerous modifications and variations can be made and effected without departing or detracting from the true spirit and novel concept of this invention disclosure. Moreover, it will be appreciated, the present disclosure is intended to set forth exemplifications which are not intended to limit the disclosure to the specific embodiments illustrated. Rather, this disclosure is intended to cover by the appended claims all such modifications and variations as fall within the spirit and scope of the claims.

What is claimed is:

1. A metal tab bending tool for securing an upright stud in place and relative to an an elongated track, with said track including an elongated generally flat web with first and second free-ended flanges extending in the same direction from opposed first and second side edges, respectively, of said web, with each flange of said track defining a plurality of side-by-side tabs extending toward said web from a free-end of each flange, and with said tab bending tool comprising:

a base;

at least two pairs of bending arms, with each bending arm of each pair of bending arms being pivotally mounted to said base, and with each pair of bending arms including a first bending arm adapted to be pivotally disposed to one side of said upright stud and a second bending arm spaced from said first bending arm and adapted to be pivotally disposed to an opposite side of said stud; and a mechanism for simultaneously pivoting at least one bending arm of each pair of bending arms toward the pivoting arm on the opposite side of said stud from a first position and into engagement with a tab on each of said first and second free-ended flanges so as to simultaneously bend opposed tabs on said first and second free-ended flanges engaged by said bending arms toward a center of said elongated track whereby inhibiting movement of said stud therepast.

2. The metal tab bending tool according to claim 1, wherein said base includes a guide portion for positioning said tool relative to said upright stud and said flat web.

3. The metal tab bending tool according to claim 1, wherein said mechanism simultaneously moves both bending arms of each pair of bending arms toward the center of said elongated track.

4. The metal tab bending tool according to claim 1, wherein said mechanism further includes structure for returning the pivotally moved bending arm of each pair of bending arms to said first position following said bending arms being moved into engagement with the opposed tabs on said first and second flanges of said elongated track.

5. The metal tab bending tool according to claim 1, wherein said mechanism includes a handle movable relative to said base.

6. The metal tab bending tool according to claim 5, wherein said mechanism further includes a transmission operably disposed between the movable handle and said bending arms for transferring movement of said handle to said bending arms.

7. The metal tab bending tool according to claim 6, further including an apparatus for spacing said stud a selected and predetermined distance from an adjacent stud.

8. A metal tab bending tool for securing an upright stud in place and relative to an elongated track, with said track including an elongated generally flat metal web having integral first and second free-ended flanges extending in the same direction from first and second opposed side edges, respectively, of said web, with each flange of said elongated track defining a plurality of side-by-side tabs extending toward said web from a free-end of each flange, and with said tab bending tool comprising:

a base configured to locate said tool relative to said upright stud and said flat web of the elongated track;

first and second pairs of bending arms each pivotally mounted to said base, with each pair of bending arms including a first bending arm adapted to be disposed to one side of said upright stud and a second bending arm spaced apart from said first bending arm and adapted to be disposed to an opposite side of said stud, with the first and second bending arms of said first pair of bending arms being laterally aligned with the first and second bending arms of said second pair of bending arms; and a mechanism for simultaneously moving the first and second bending arms of each pair of bending arms from a first position and into engagement with spaced tabs on each of said first and second free-ended flanges so as to bend the spaced tabs engaged by said bending arms toward a center of said elongated web whereby straddling and entrapping said stud therebetween.

9. The metal tab bending tool according to claim 8, wherein said base includes a guide portion for positioning said tool and upright stud relative to each other.

10. The metal tab bending tool according to claim 8, wherein said mechanism further includes structure for automatically returning both bending arms of each pair of bending arms to said first position following said bending arms being moved into engagement with the opposed tabs on said first and second flanges of said elongated track.

11. The metal tab bending tool according to claim 8, further including an apparatus for spacing said stud a selected and predetermined distance from an adjacent stud.

12. The metal tab bending tool according to claim 8, wherein said mechanism includes a handle movable relative to said base.

13. The metal tab bending tool according to claim 12, wherein said mechanism further includes a transmission operably disposed between the movable handle and said bending arms for transferring movement of said handle to said bending arms.

14. The metal tab bending tool according to claim 13, wherein the transmission of said mechanism includes a pair of intermeshing gear segments arranged in operable combination with at least one of said bending arms on each pair of bending arms.

15. The metal tab bending tool according to claim 13, wherein the transmission of said mechanism includes an apparatus for interconnecting the first bending arm on said first pair of bending arms with the first bending arm on said second pair of bending arms.

16. A metal tab bending tool for securing an upright stud in place and relative to an elongated track, with said elongated track including an elongated generally flat metal web having integral first and second free-ended flanges extending in the same direction from first and second opposed side edges, respectively, of said web, with each flange of said elongated track defining a plurality of side-by-side tabs extending toward said web from a free-end of each flange, and with said tab bending tool comprising:

a base configured to position said tool relative to said upright stud and the flat web on the elongated track;

first and second pairs of bending arms each pivotally mounted to said base, with each pair of bending arms including a first bending arm adapted to be disposed to one side of said upright stud and a second bending arm spaced from said first bending arm and adapted to be disposed to an opposite side of said stud, with the first and second bending arms of said first pair of bending arms being laterally aligned with the first and second being arms of said second pair of bending arms; and a force transfer mechanism disposed between and for simultaneously moving the bending arms of each pair of bending arms from a first position and into engagement with tabs on each of said first and second free-ended flanges so as to bend the spaced tabs engaged by said bending arms toward a center of said elongated web whereby straddling and entrapping said stud therebetween.

17. The metal tab bending tool according to claim 16, wherein said base includes a guide portion for locating said tool relative to said upright stud and said flat web.

18. The metal tab bending tool according to claim 16, further including an apparatus for spacing said stud a selected and predetermined distance from an adjacent stud.

19. The metal tab bending tool according to claim 16, wherein said force transfer mechanism includes structure for automatically returning both bending arms of each pair of bending arms to said first position following said bending arms being moved into engagement with the opposed tabs on said first and second flanges of said elongated track.

20. The metal tab bending tool according to claim 16, wherein said force transfer mechanism includes a handle operably connected to one of said bending arms and movable relative to said base.

21. A method for securing an upright stud in place and relative to an elongated track, with said elongated track including an elongated generally flat web with first and second free-ended flanges extending in the same direction from first and second opposed side edges, respectively, of said web, with each flange of said elongated track defining a plurality of side-by-side tabs extending toward said web from a free-end of each flange, and with the tabs on the first flange of the elongated track being generally laterally aligned with the tabs on the second flange of the elongated track, and wherein said method comprising the step of:

bending laterally aligned tabs on the first and second flanges of said elongated track inwardly and simultaneously toward a center of said elongated track, with said tabs being bent being disposed immediately adjacent to one side of said stud whereby inhibiting movement of said stud therepast.

22. The method for securing an upright stud in place and relative to the elongated track according to claim 21 including the further step of:

positioning a tool relative to said upright stud and the flat web said elongated track, with said tool including at least two pairs of bending arms, with each pair of bending arms including a first bending arm adapted to be disposed to one side of said upright stud and a second bending arm spaced apart from said first bending arm and adapted to be disposed to an opposite side of said stud.

23. The method for securing an upright stud in place and relative to the elongated track according to claim 21 including the further step of:

bending other laterally aligned tabs on the first and second flanges of said elongated track inwardly and simultaneously toward a center of said elongated track, with said other laterally aligned tabs being bent being disposed immediately adjacent an opposed side of said stud whereby the bent tabs on each flange of said elongated track straddling and entrapping said stud therebetween.

24. A method for securing an upright stud in place and relative to upper and lower elongated tracks, with each elongated track including an elongated generally flat web with first and second free-ended flanges extending in the same direction from first and second opposed side edges, respectively, of said web, with the flanges of each elongated track defining a plurality of side-by-side tabs extending toward said web from a free-end of each flange, and with the tabs on the first flange of each elongated track being generally laterally aligned with the tabs on the second flange of each elongated track, and wherein said method comprising the step of:

bending laterally aligned tabs on the first and second flanges of each elongated track inwardly and simultaneously toward a center of the respective elongated track, with said tabs being bent being disposed immediately adjacent to one side of said stud whereby inhibiting movement of said stud therepast.

25. The method for securing an upright stud in place and relative to the elongated tracks according to claim 24 including the further step of:

positioning tools relative to said upright stud and the flat web each elongated track, with each tool including at least two pairs of bending arms, with each pair of bending arms of each tool including a first bending arm adapted to be disposed to one side of said upright stud and a second bending arm spaced apart from said first bending arm and adapted to be disposed to an opposite side of said stud.

26. The method for securing an upright stud in place and relative to the elongated tracks according to claim 24 including the further step of:

bending other laterally aligned tabs on the first and second flanges of each elongated track inwardly and simultaneously toward a center of the respective elongated track, with said other laterally aligned tabs being bent being disposed immediately adjacent an opposed side of said stud whereby the bent tabs on each flange of each elongated track straddle and entrap said stud therebetween.

* * * * *